US010392169B2

(12) United States Patent
Wu

(10) Patent No.: US 10,392,169 B2
(45) Date of Patent: Aug. 27, 2019

(54) LUNCH BOX

(71) Applicant: Jingdong Wu, Taishan (CN)

(72) Inventor: Jingdong Wu, Taishan (CN)

( * ) Notice: Subject to any disclaimer, the term of this patent is extended or adjusted under 35 U.S.C. 154(b) by 119 days.

(21) Appl. No.: 15/625,131

(22) Filed: Jun. 16, 2017

(65) Prior Publication Data

US 2018/0022517 A1 Jan. 25, 2018

(30) Foreign Application Priority Data

Jul. 22, 2016 (CN) ..... 2016 2 0782074 U

(51) Int. Cl.
*B65D 51/16* (2006.01)
*A45C 11/20* (2006.01)
*B65D 43/02* (2006.01)

(52) U.S. Cl.
CPC ..... *B65D 51/1683* (2013.01); *A45C 11/20* (2013.01); *B65D 43/0208* (2013.01); *B65D 2543/00092* (2013.01); *B65D 2543/00555* (2013.01)

(58) Field of Classification Search
CPC ..... B65D 51/1683; B65D 43/0208; B65D 2543/00092; B65D 2543/00555; A45C 11/20
USPC ..... 220/254.3, 254.5, 231, 367.1, 271
See application file for complete search history.

(56) References Cited

U.S. PATENT DOCUMENTS 1,032,372 A * 7/1912 Berry ..... 220/782
3,410,436 A * 11/1968 Foss ..... B65D 51/1677 215/249
4,513,883 A * 4/1985 Melzi ..... B65D 17/4012 222/83
5,363,978 A * 11/1994 Molo ..... B65D 51/1683 220/254.3
5,979,688 A * 11/1999 Stodd ..... B65D 81/2015 215/253

(Continued)

FOREIGN PATENT DOCUMENTS

CN 201595324 U 10/2010
CN 202407536 U 9/2012
CN 204132638 U 2/2015

*Primary Examiner* — James N Smalley

(74) *Attorney, Agent, or Firm* — Mintz Levin Cohn Ferris Glovsky and Popeo, P.C.; Kongsik Kim; Derek E. Constantine

(57) ABSTRACT

The present invention relates to a lunch box, including a base and a lid, wherein the lid is disposed on the base and snap-fitted with it, and by which the base and the lid form a storage cavity there-between, and at least one movable sheet is provided on the lid by cutting, and a pit is defined by the lid and an outer edge of the movable sheet. A flange is provided on the lid surrounding the movable sheet. One end of the movable sheet is closely connected with the lid and a foldable hinge is formed at the junction. The movable sheet can bend up and down with the foldable hinge as its axis. Compared with the prior art, the movable sheet is provided on the top of the lid. When air emission is needed, external force can be exerted to the movable sheet, undermining the original connecting structure to produce a vent hole between the movable sheet and the lid. This vent hole can circulate the inside air and the outside air and prevent from the backflow phenomenon when heating food.

6 Claims, 3 Drawing Sheets

(56) References Cited

U.S. PATENT DOCUMENTS

| | | | | |
|---|---|---|---|---|
| 2009/0200296 | A1* | 8/2009 | Iwasaki | B29C 45/33 219/735 |
| 2013/0118133 | A1* | 5/2013 | Jacober | B65D 51/00 53/492 |

* cited by examiner

LUNCH BOX

CROSS-REFERENCE TO RELATED APPLICATION

This application claims priority to CN 201620782074.X filed on Jul. 22, 2016, which is incorporated herein by reference.

TECHNICAL FIELD

The following invention relates to a tableware, in particular to a lunch box.

BACKGROUND ART

Currently, plastic lunch boxes are widely used and gradually replacing other lunch boxes, because of its good sealing performance, being easy to clean, lightweight, beautiful appearance and etc. In the prior art, a lid of a lunch box covers its base, making the inside of the lunch box airtight, further leading to not only good heat preservation effect, but also effectively preventing food leakage. Because the air tightness directly affects the use of the lunch box, most of the lunch boxes in the prior art have good sealing performance and no other air channels. However, good performance of air tightness will bring certain disadvantages. For example, when a lunch box is used in low temperature environment, the contraction of the internal air makes the lunch box difficult to open under atmospheric pressure. The internal air of the lunch box will inflate when heating, easily resulting in lid deformation, even the lid bulging, and further causing food splash, etc. Meanwhile when the lunch box is heated, water vapor inside the lunch box can't be vented, and steam backflow phenomenon will appear, leading to difficulty in keeping the original taste of the food, inconvenience in using and potential safety hazard.

SUMMARY

To overcome the defects in the prior art, the present invention provides a lunch box having more functions than traditional ones. The lunch box is provided with a movable sheet on the top of the lid. When air emission is needed, external force can be exerted to the movable sheet, undermining the original connecting structure to produce a vent hole between the movable sheet and the lid. This vent hole can circulate the inside air and the outside air and prevent from the backflow phenomenon when heating food, as well as keeping the food fresh.

The following technical solutions are adopted of embodiments of the present invention.

A lunch box, comprises a base and a lid, wherein the lid is disposed on the base and snap-fitted with it, thereby forming a storage cavity between the base and the lid, and at least one movable sheet is provided on the lid by cutting, and a pit is defined by the lid and an outer edge of the movable sheet.

Compared with the prior art, the movable sheet is provided on the top of the lid. When air emission is needed, external force can be exerted to the movable sheet, undermining the original connecting structure to produce a vent hole between the movable sheet and the lid. This vent hole can circulate the inside air and the outside air and prevent from the backflow phenomenon when heating food. The lunch box has the advantages of simple structure, convenient use and low cost.

Further, a flange is provided on the lid surrounding the movable sheet. The flange can guarantee the cleanness of the pits formed between the movable sheet and the lid, and avoid losing air tightness of the lunch box caused by the accidently touching when the movable sheet is not being used.

Further, one end of the movable sheet is closely connected with the lid and a foldable hinge is formed at the junction. One end of the movable sheet is not forming pit with the lid, to guarantee the movable sheet will not fall down, and the movable sheet can bend up and down with the foldable hinge as its axis.

Further, the pit formed between the outer edge of the movable sheet and the lid is circular arc, and the foldable hinge is linear.

Further, the height of the flange is 0.2 mm-1 mm

Further, the area of the movable sheet is 50 $mm^2$-200 $mm^2$.

Further, an edge of the lid is provided with a lid edge engagement portion; an edge of the base is provided with a base edge engagement portion; and the base edge engagement portion is embedded in the lid edge engagement portion.

Further, the lid edge engagement portion is provided with a folded edge which horizontally extends outwards. The folded edge helps the user to open the lid and prevent the base edge engagement portion of the lunch box from being contaminated.

Further, the cross section of the base edge engagement portion is trapezoid.

Further, the top of the lid is provided with annular grooves. The annular grooves increase the convexity of the lid, making it convenient for the users to hold and put down the lunch box, as well as avoiding its slipping out of hands.

BRIEF DESCRIPTION OF THE DRAWINGS

Some of the embodiments will be described in detail, with reference to the following figures, wherein like designations denote like members, wherein.

DETAILED DESCRIPTION

In order to describe embodiments of the present invention in further detail to achieve the objective of embodiments of the present invention and technical effects thereof, the structural characteristics of a base with lid provided by embodiments of the present invention are described in detail with reference to the embodiments and attached drawings. The detailed description is as follows.

The lunch box comprises a base and a lid. The lid is disposed on the base and snap-fitted with it. The base and the lid form a storage cavity there-between. An edge of the lid is provided with a lid edge engagement portion; an edge of the base is provided with a base edge engagement portion; and the base edge engagement portion is embedded in the lid edge engagement portion.

Figure 1:
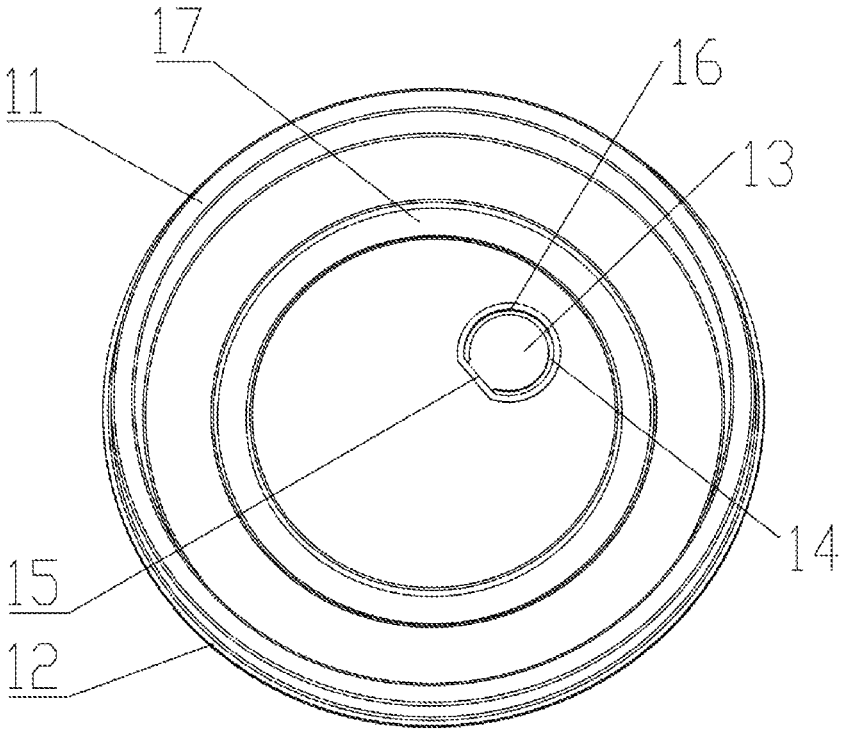
FIG. 1 is a perspective view of the lid of the lunch box of the present invention.
Figure 2:
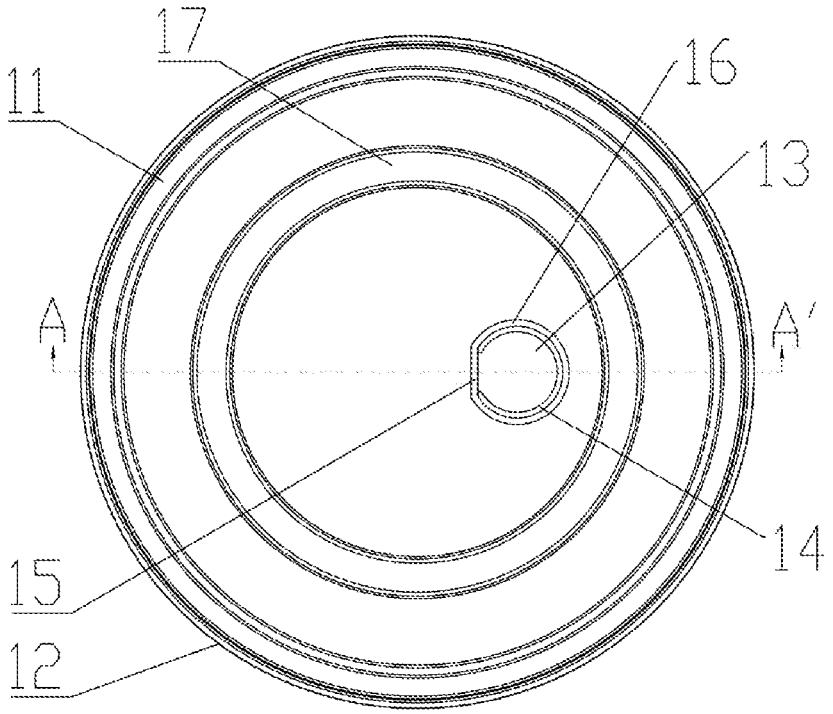
FIG. 2 is a structural top view of the lid in FIG. 1.
Figure 3:
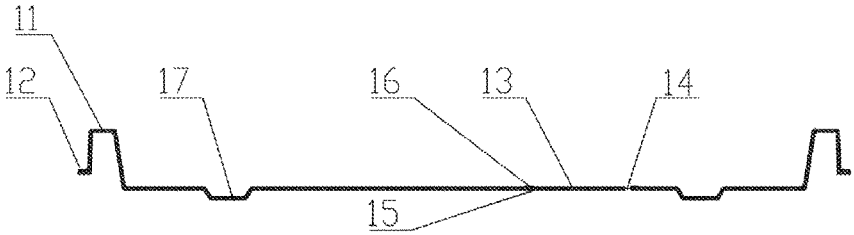
FIG. 3 is a sectional view of the lid in FIG. 2 in A-A' direction.
Figure 4:
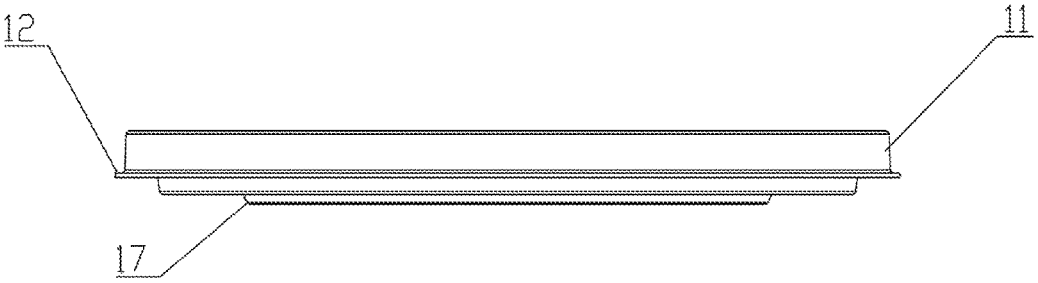
FIG. 4 is a structural front view of the lid in FIG. 1.

Referring to FIGS. 1 to 4, which are the perspective view, top view, cross sectional view in A-A' direction and the front view of the lid of the lunch box of the present invention. The lid edge engagement portion 11 is provided with a folded edge 12 which horizontally extends outwards. The folded edge 12 helps the user to open the lid and prevent the base edge engagement portion of the lunch box from being contaminated. The cross section of the base edge engagement portion 11 is trapezoid, but it is not limited to trapezoid. Other shapes are feasible, such as arc and so on. The upper part of the cross sections of the lid edge engagement portion 11 is smaller than the lower part in size. When a plurality of lids are superposed respectively, the distance between adjacent lids is bridged, thus reducing the space for placement of the lids and bringing convenience to transportation. At least one movable sheet 13 is provide on the lid by cutting. A pit 14 is defined by an outer edge of the movable sheet 13 and the lid. The area of the movable sheet 13 is 50 $mm^2$-200 $mm^2$. The size of the movable sheet 13 can guarantee the air circulation and avoid losing air tightness if the movable sheet is with excessive size. One end of the movable sheet 13 is closely connected with the lid and a foldable hinge 15 is formed at the junction. One end of the movable sheet 13 is not forming pit with the lid, to guarantee the movable sheet 13 will not fall down, and the movable sheet 13 can bend up and down with the foldable hinge 15 as its axis. A flange 16 is provided on the lid surrounding the movable sheet 13. The height of the flange is 0.2 mm-1 mm. The height of the movable sheet can avoid the accidently touching and avoid the difficulty in exerting external force onto the movable sheet if the flange is with excessive height. The flange 16 can guarantee the cleanness of the pit 14 formed between the movable sheet 13 and the lid, and avoid losing air tightness of the lunch box caused by the accidently touching when the movable sheet 13 is not being used. In the embodiment, the pit 14 formed between the outer edge of the movable sheet 13 and the lid is circular arc, and the foldable hinge 15 is linear. The circular arc pit 14 guarantees that the movable sheet 13 can bend up and down smoothly with foldable hinge 15 as its axis, and the movable sheet 13 will not scratch the lid. The movable sheet 13 on the top of the lid in the present invention is not limited in lunch boxes, it can also be used in other structures, such as soup cup. The movable sheet can be pressed down for ventilation or for the insertion of the straws, etc.

The cross section of the base edge engagement portion matches with the cross section of the lid edge engagement portion 11. The upper part of the cross sections of the base edge engagement portion is smaller than the lower part in size. When a plurality of bases are superposed respectively, the distance between adjacent bases is bridged, thus reducing the space for placement of the bases and bringing convenience to transportation.

In this embodiment, the lid is circular lid, and the base are circular base matched with the lid. The top of the lid is provided with annular grooves 17. The annular grooves 17 increase the convexity of the lid, making it convenient for the users to hold and put down the lunch box, as well as avoiding its slipping out of hands. The shapes of the base and the lid are not limited to the circular structure. They may appear in other shapes, such as square structures or elliptical structures, etc.

When using the lunch box of the present invention, the lid is disposed on the base, and the lid edge engagement portion 11 and the base edge engagement portion are snap-fitted with each other. And the base edge engagement portion is embedded in the lid edge engagement portion 11, making the sealing tightly between the base and the lid, and preventing from easy separation of the base from the lid. When air emission or change is needed, external force should be exerted onto the movable sheet 13, to break up the pit 14 between the outer edge of the movable sheet 13 and the lid, so that the movable sheet 13 can bend up and down with the foldable hinge 15 as its axis, leading to the formation of a vent hole on the lid. The vent hole will circulate the inside air and the outside air. After the use of the lunch box, the lid can be moved away when the lunch box needs to be sealed again, then exert force can be exerted onto the movable sheet 13, making the movable sheet 13 bend back to the position horizontal with the lid. The flange 16 surrounding the movable sheet 13 ensures the cleanness of the pit 14 formed between the movable sheet 13 and the lid and avoids losing air tightness of the lunch box caused by the accidently touching when the movable sheet 13 is not being used.

Compared with prior art, the movable sheet is provided on the top of the lid. When air emission is needed, external force can be exerted to the movable sheet, undermining the original connecting structure to produce a vent hole between the movable sheet and the lid. This vent hole can circulate the inside air and the outside air and prevent from the backflow phenomenon when heating food. The lunch box has the advantages of simple structure, convenient use and low cost.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. A lunch box comprising:

a base having an edge, the edge of the base having a base edge engagement portion; and a lid having a top and an edge, the top of the lid having an upward annular groove such that an inner width of the upward annular groove increases from bottom to top, the edge of the lid having a lid edge engagement portion, the base edge engagement portion being embedded in the lid edge engagement portion, the lid edge engagement portion including:

an upward extension part extending upward and outward from the edge of the lid;

a horizontal extension part, one end of the horizontal extension part connecting with a top of the upward extension part; and a downward extension part, another end of the horizontal extension part extending horizontally outward and connecting with a top of the downward extension part, and a bottom edge of the downward extension part having a folded edge that horizontally extends outwards;

wherein the upward extension part, the horizontal extension part, and the downward extension part have equal thickness; and the upward extension part, the horizontal extension part, and the downward extension part form a downward notch such that an inner width of the downward notch increases from top to bottom;

wherein the lid is disposed on the base and snap-fitted therewith such that a storage cavity is defined between the base and the lid, at least one movable sheet is provided on the lid by cutting the lid, and a pit is defined by the lid and an outer edge of the movable sheet.

2. The lunch box according to claim 1, wherein the lid has a flange surrounding the movable sheet.

3. The lunch box according to claim 2, wherein one end of the movable sheet is connected with the lid such that a foldable hinge is formed at a junction therebetween.

4. The lunch box according to claim 2, wherein the pit formed between the outer edge of the movable sheet and the lid is a circular arc, and the foldable hinge is linear.

5. The lunch box according to claim 2, wherein a height of the flange is between about 0.2 mm and about 1 mm.

6. The lunch box according to claim 1, wherein an area of the movable sheet is between about 50 $mm^2$ and about 200 $mm^2$.

* * * * *